US009919329B2

(12) United States Patent
Bruder

(10) Patent No.: US 9,919,329 B2
(45) Date of Patent: Mar. 20, 2018

(54) DISPENSER SYSTEM

(71) Applicant: Thomas Bruder, Constance (DE)

(72) Inventor: Thomas Bruder, Constance (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 11 days.

(21) Appl. No.: 15/132,618

(22) Filed: Apr. 19, 2016

(65) Prior Publication Data

US 2016/0303603 A1 Oct. 20, 2016
US 2017/0165696 A9 Jun. 15, 2017

(30) Foreign Application Priority Data

Apr. 20, 2015 (EP) ..... 15164230

(51) Int. Cl.
*B05B 11/00* (2006.01)
*B65B 3/12* (2006.01)
*A45D 34/00* (2006.01)

(52) U.S. Cl.
CPC ..... *B05B 11/3087* (2013.01); *A45D 34/00* (2013.01); *B05B 11/0056* (2013.01);
(Continued)

(58) Field of Classification Search
CPC ..... A45D 34/00; A45D 2200/054; B05B 11/0056; B05B 11/3023; B05B 11/3035; B05B 11/3047; B05B 3/12; B05B 1/3421; B05B 1/3436; B05B 11/304; B05B 11/3025; B05B 11/06
(Continued)

(56) References Cited

U.S. PATENT DOCUMENTS 3,171,446 A * 3/1965 Koch ..... G01F 11/08 141/24
3,323,689 A * 6/1967 Elmore ..... B05B 11/3032 222/209

(Continued)

FOREIGN PATENT DOCUMENTS

DE 20 2005 021 956 U1 1/2012
DE 10 2013 218 741 A1 3/2015
WO WO2015/039823 A1 3/2015

*Primary Examiner* — Jason K Niesz
*Assistant Examiner* — James Hakomaki
(74) *Attorney, Agent, or Firm* — Flynn, Thiel, Boutell & Tanis, P.C.

(57) ABSTRACT

A dispenser system including a first dispenser module having a medium chamber fillable with medium, a first discharge head actuable for discharging medium from the medium chamber, a refilling opening, and a second dispenser module coupleable to the first dispenser module for refilling the latter. The second dispenser module has a storage container for medium, and a second discharge head. In the decoupled state of the dispenser modules, the second discharge head is actuable for discharging the medium out of the storage container and has a discharge opening. The second discharge head has a ventilation system for equalizing the pressure in the storage container when the medium is discharged. The dispenser system has an air pump system. In the coupled state of the dispenser modules, the air pump system is fluidly coupled to the ventilation system and conveys air via the ventilation system into the storage container.

13 Claims, 2 Drawing Sheets

(52) U.S. Cl.
CPC ..... *B05B 11/3023* (2013.01); *B05B 11/3035* (2013.01); *B05B 11/3047* (2013.01); *B65B 3/12* (2013.01); *A45D 2200/054* (2013.01)

(58) Field of Classification Search
USPC ..... 141/113; 239/404, 361, 355; 206/438
See application file for complete search history.

(56) References Cited

U.S. PATENT DOCUMENTS 5,306,125 A * 4/1994 Weag ..... B05B 11/0027 222/207
5,524,680 A * 6/1996 de Laforcade ..... B05B 11/0037 141/113
5,950,879 A * 9/1999 Ritsche ..... B05B 11/0018 141/18
6,863,093 B2 * 3/2005 Garcia ..... A61M 11/06 141/18
7,740,151 B2 * 6/2010 Stone ..... F04B 33/00 137/212
7,850,043 B2 * 12/2010 Foster ..... B05B 11/0056 206/219
8,079,388 B2 12/2011 Turgeman
8,616,414 B2 * 12/2013 Ciavarella ..... B05B 7/0037 222/1
8,631,975 B2 * 1/2014 Lim ..... A45D 34/04 222/256
8,881,775 B2 11/2014 Turgeman
9,266,132 B2 * 2/2016 Dumont ..... A45D 34/02
2002/0020716 A1 * 2/2002 Albisetti ..... B05B 11/0029 222/160
2007/0194954 A1 * 8/2007 Yamashita ..... H03M 7/04 341/50
2009/0136370 A1 * 5/2009 Goodwin ..... F04B 43/084 417/472
2009/0194191 A1 8/2009 Turgeman
2011/0209110 A1 * 8/2011 Dumont ..... F21V 21/00 716/110
2012/0090730 A1 * 4/2012 Dumont ..... A45D 34/02 141/2
2012/0090733 A1 4/2012 Turgeman
2013/0019991 A1 * 1/2013 Muller ..... B05B 11/0056 141/18
2013/0126639 A1 * 5/2013 Tu ..... B05B 11/0056 239/302
2013/0161417 A1 * 6/2013 Songbe ..... B05B 1/02 239/404
2013/0306757 A1 * 11/2013 Parmentier ..... B05B 1/3436 239/404
2014/0060695 A1 * 3/2014 Dumont ..... B05B 11/0056 141/18
2014/0102584 A1 * 4/2014 Lasnier ..... B05B 11/0056 141/18
2014/0175129 A1 * 6/2014 Croibier ..... B05B 11/0097 222/321.9
2014/0238532 A1 * 8/2014 Fangrow ..... A61J 1/2096 141/2
2014/0305543 A1 * 10/2014 Lasnier ..... B65B 3/10 141/18
2016/0023228 A1 * 1/2016 Scott ..... A45D 34/02 141/2
2017/0001208 A1 * 1/2017 Barenhoff ..... B05B 11/0032
2017/0043365 A1 * 2/2017 Hui ..... B05B 11/0051

* cited by examiner

DISPENSER SYSTEM

CROSS-REFERENCE TO RELATED APPLICATIONS

This claims priority from European Patent Application No. 15164230.3, filed on Apr. 20, 2015, the disclosure of which is hereby incorporated by reference in its entirety into this application

FIELD OF THE INVENTION

The invention relates to a dispenser system, comprising a first dispenser module having a medium chamber which is fillable with a medium, having a first discharge head which is actuable for discharging the medium out of the medium chamber, and having a refilling opening, and a second dispenser module which is coupleable to the first dispenser module for refilling the first dispenser module, having a storage container for storing the medium. The invention furthermore relates to a method for refilling a dispenser module.

BACKGROUND OF THE INVENTION

A dispenser system of this type is known, for example, from DE 20 2005 021 956 U1. In the case of the system known from DE 20 2005 021 956 U1, the medium in the storage container is under pressure. A discharge device comprising a valve, a hollow shaft and a spray head arranged on the hollow shaft is attached to the storage container. In order to discharge the medium out of the second dispenser module in a decoupled state of the dispenser modules, the hollow shaft is shifted by means of the spray head, which is arranged thereon, in order to open the valve. In order to couple the first dispenser module to the second dispenser module, the spray head is removed from the second dispenser module, and the hollow shaft is inserted into the refilling opening of the first dispenser module.

The dispenser system makes it possible for the user to carry a smaller volume of a certain medium than customary stored in a storage container, for example on trips or in handbags and/or briefcases. The pressurized medium is preferably a liquid medium, such as a perfume. However, using a dispenser system with a pasty medium, such as a cream, a lotion or an emulsion, is also desirable.

SUMMARY OF THE INVENTION

The invention provides a cost-effective dispenser system in which a medium is stored under normal pressure in the storage container and provides a method for refilling a dispenser module.

According to a first aspect, a dispenser system is provided, comprising a first dispenser module having a medium chamber which is fillable with a medium, having a first discharge head which is actuable for discharging the medium out of the medium chamber, and having a refilling opening, and a second dispenser module which is coupleable to the first dispenser module, having a storage container for storing the medium, and having a second discharge head which is attached to the storage container of the second dispenser module, and in the decoupled state of the dispenser modules is actuable for discharging the medium out of the storage container and has at least one discharge opening, wherein the second discharge head has a ventilation system for the purpose of equalizing the pressure in the storage container when the medium is discharged, wherein the dispenser system comprises an air pump system, and wherein, in the coupled state of the dispenser modules, the air pump system is fluidically coupled to the ventilation system of the second discharge head and is actuable in order to convey air via the ventilation system into the storage container.

The ventilation system is part of the second discharge head, and therefore no special measures have to be taken at the storage container. In a refinement, the ventilation system has a nonreturn valve which opens for the purpose of equalizing the pressure. In other refinements, the ventilation system is released when the second discharge head is actuated and is blocked in the unactuated state. The ventilation system can be suitably designed in a conventional manner by a person skilled in the art. Depending on requirements, for example, an air filter or the like is provided in the ventilation system in order to avoid an admission of germs via the ventilation system. In a refinement, the medium is received directly into the storage container. In other refinements, the medium is received into a flexible bag in the storage container, wherein the medium is protected in the bag against contact with the environment.

In the decoupled state, the first dispenser module and the second dispenser module are both usable by themselves. For this purpose, the discharge heads preferably each have pump units, by means of which a medium is conveyed in a conventional manner in the direction of a discharge opening. In the coupled state, a positive pressure is produced in the storage container by means of the air pump system, said positive pressure causing the medium to be displaced out of the storage container, and therefore the medium is conveyed, bypassing a discharge mechanism of the second dispenser module. Since the positive pressure acts only for a short time and the medium is not discharged under positive pressure, the dispenser module can also be used with pasty media.

In a refinement, the air pump system is designed as an independent constructional unit, wherein, in a development, the dispenser modules are coupled by means of the air pump system. In order to provide a captive system, in other refinements the air pump system is designed as a joint constructional unit with the first or the second dispenser module. The air pump system and the first dispenser module are preferably designed as a joint constructional unit. It is thereby prevented that operation of the air pump system in the decoupled state brings about an undesirable rise in pressure in the storage container and therefore a discharge of the medium.

In a refinement, the air pump system has an automatic or semiautomatic, motorized and/or magnetic drive. In advantageous refinements, the air pump system is designed as a manually actuable air pump system with a variable-volume pump chamber. In the event of an increase in volume, air is sucked into the pump chamber and, in the event of a reduction in volume, air is conveyed out of the pump chamber via the ventilation system into the storage container. In a refinement, a shiftable piston is assigned to the pump chamber.

In advantageous refinements, the pump chamber has a reversibly deformable wall. By action of a force on the wall, the wall is deformed, and therefore a volume of the pump chamber is reduced. The air located in the pump chamber is conveyed via the ventilation system into the storage container. When the force on the wall ceases, the wall resumes the original shape because of internal restoring forces, wherein air is sucked up out of the environment. By means of suitable means, sucking of air and/or medium out of the storage container is prevented and sucking of air out of the environment is ensured.

In a refinement, the wall is deformed by applying forces in the radial direction of the first dispenser module. In advantageous refinements, the deformable wall is designed as a bellows which is variable in length in the axial direction of the first dispenser module. Depending on requirements, a bellows can be designed in a suitably robust manner. This is advantageous in particular if the air pump system is designed as a joint constructional unit with the first dispenser module and is carried by the user in handbags, briefcases or in luggage. The bellows is shortened by application of an external force. When the force ceases, the bellows again assumes the original shape because of internal restoring forces or an additional spring element.

In a further refinement, the second discharge head has a pressure chamber, wherein the pressure chamber is fluidically connected to the storage container via an inlet valve. In the decoupled state, when the second discharge head is actuated, a negative pressure is produced in the pressure chamber, and therefore the inlet valve to the pressure chamber opens. In the coupled state, a positive pressure is produced in the storage container, bypassing an actuator of the second discharge head, when the air pump system is actuated, and therefore the inlet valve to the pressure chamber opens.

In a refinement, at least one plunger is provided on the air pump system and/or on the first dispenser module, wherein, in a coupled state, a valve assigned to the refilling opening and/or a valve assigned to the at least one discharge opening of the second discharge head is opened in a forcibly guided manner by means of the at least one plunger. If both valves are opened, in a coupled state the medium chamber is permanently in communication with the second discharge head, in particular with a pressure chamber of the second discharge head. When a negative pressure is produced in the medium chamber, for example because of a discharge of a medium, and/or, when a positive pressure is produced in the storage container by means of the air pump system, medium is conveyed out of the storage container into the medium chamber.

In a refinement, the second discharge head has only a single discharge opening via which, in the decoupled state, the medium is discharged and, in the coupled state, is supplied to the medium chamber. In other refinements, the discharge head has a first discharge opening, which is arranged, for example, on a side wall, and a second discharge opening, which is arranged, for example, at an upper end of the second discharge head, wherein, in a coupled state of the dispenser modules, the first discharge opening is closed and the first dispenser module is fluidically coupled to the second discharge opening and, in a decoupled state of the dispenser modules, the second discharge opening is closed and the medium is dischargeable via the first discharge opening when the second discharge head is actuated. The two discharge openings are suitably adaptable here in size, arrangement and shaping to the respective purpose.

In a refinement, the first dispenser module, the second dispenser module and/or the air pump system have complementary coupling means for a coupling to one another which is releasable without destruction and is restorable.

The air pump system preferably has a coupling sleeve which is placeable onto the second discharge head.

In advantageous refinements, the second discharge head has a pump unit which is actuable in order to discharge the medium, wherein the ventilation system comprises a ventilation and venting path, which is released when the pump unit is actuated, and wherein, in the coupled state of the dispenser modules, the pump unit of the second discharge head is at least partially transferred into an actuated state. In advantageous refinements, a sealing element is provided on the second discharge head, in particular on the pump unit thereof, said sealing element closing a ventilation opening of the ventilation and venting path in an unactuated state and opening up same in an actuated state. If, in the coupled state of the dispenser modules, the pump unit of the second dispenser module is transferred into the actuated state, the ventilation opening is therefore opened up. The pump unit is transferred here, in a refinement, in the coupled state into an end position of the actuation. In other refinements, the pump unit is transferred into an actuated state during the coupling only as far as a position in which the ventilation and venting path is opened up.

According to a second aspect, a method is provided for refilling a dispenser module of a dispenser system comprising a first dispenser module having a medium chamber which is fillable with a medium, and a refilling opening, and a second dispenser module which is coupleable to the first dispenser module for refilling the latter, having a storage container for storing the medium and a second discharge head which is attached to the storage container of the second dispenser module and, in the decoupled state of the dispenser modules, is actuable for discharging the medium out of the storage container, wherein, in the coupled state of the dispenser modules, air is conveyed into the storage container via a ventilation system, which is provided on the second discharge head for the purpose of equalizing the pressure in the storage container when the medium is discharged, and therefore a positive pressure is produced in the storage container. The positive pressure produced in the storage container is used in order to convey the medium out of the storage container into the medium chamber of the first dispenser module. Air is conveyed via the ventilation system into the storage container preferably by means of a suitable air pump system, for example an air pump system comprising a bellows.

BRIEF DESCRIPTION OF THE DRAWINGS

Further advantages and aspects of the invention emerge from the description below of a preferred exemplary embodiment of the invention, which is explained with reference to the figures, in which.

DETAILED DESCRIPTION

Figure 1:
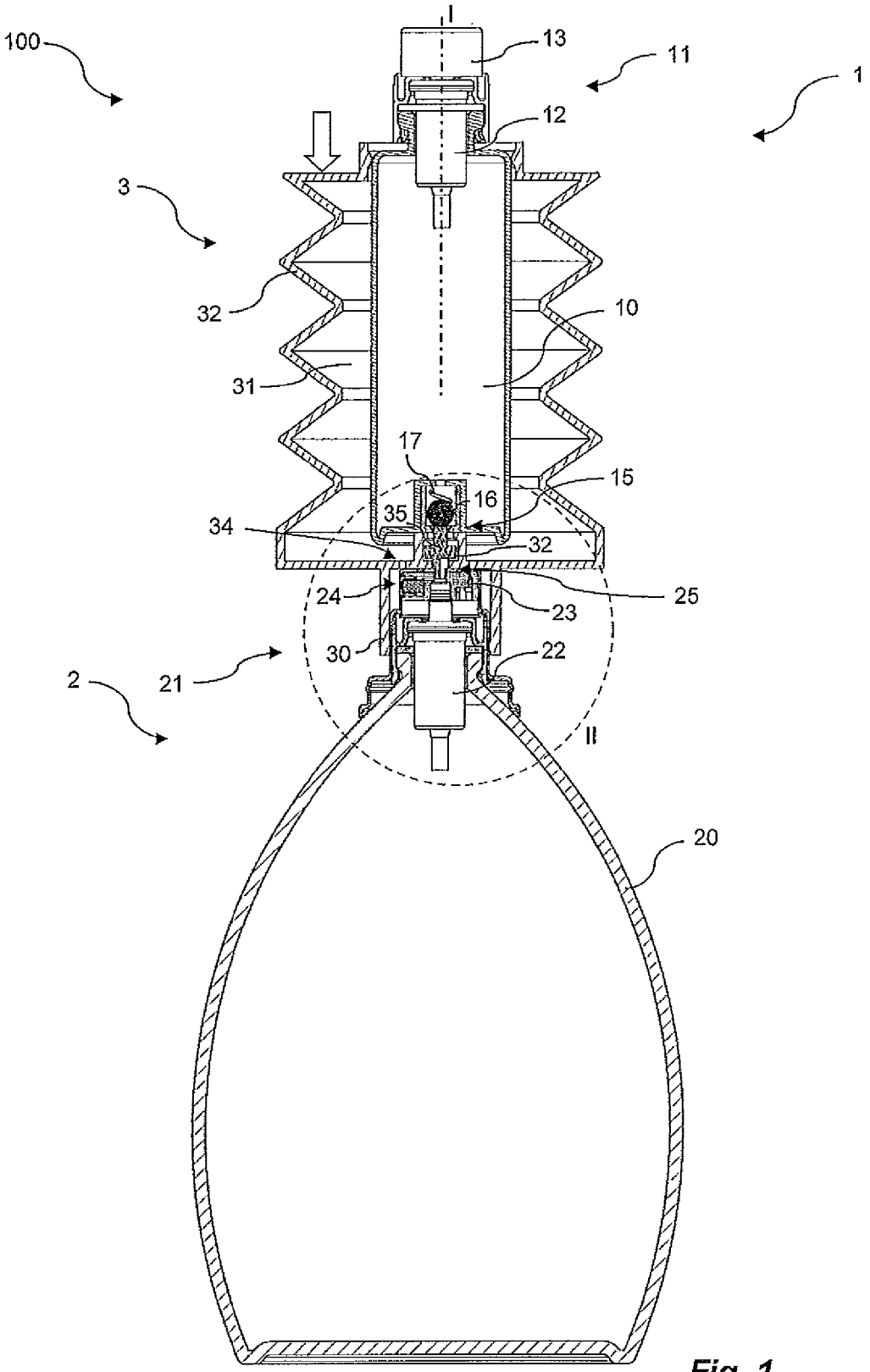
FIG. 1 shows a partially sectioned illustration of a dispenser system.
Figure 2:
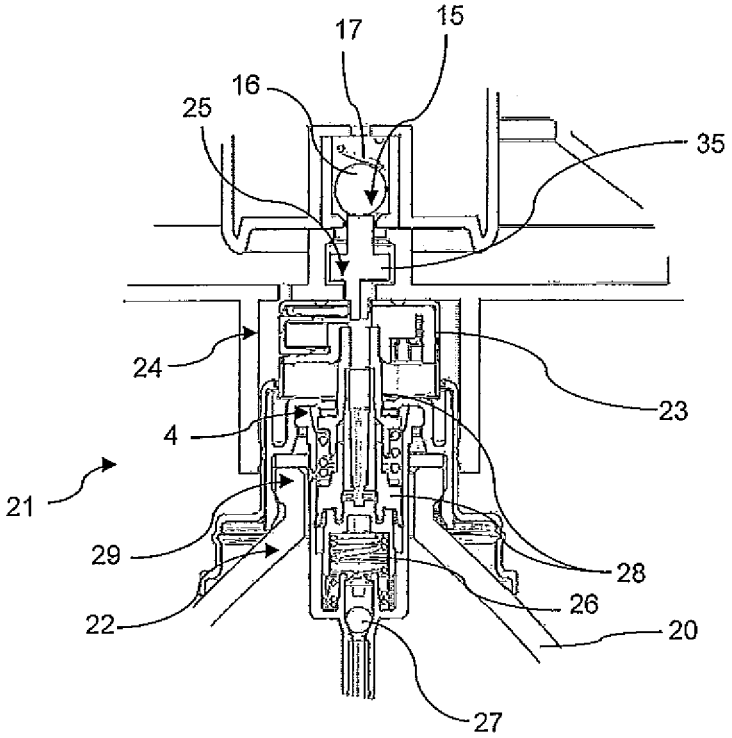
FIG. 2 shows a detail II according to FIG. 1.

FIG. 1 schematically shows a dispenser system 100 comprising a first dispenser module 1, a second dispenser module 2 which is coupleable to the first dispenser module 1, and an air pump system 3. FIG. 2 shows a detail II of the dispenser system 100 according to FIG. 1 in a sectioned illustration.

The first dispenser module 1 has a medium chamber 10 which is fillable with a medium, and a first discharge head 11 which is actuable for discharging the medium out of the medium chamber 10. The discharge head 11 illustrated comprises a pump unit 12 and a spray head 13 which is shiftable relative to the medium chamber 10 in order to actuate the discharge head 11. Actuation of the discharge head 11 in order to discharge the medium stored in the medium chamber 10 is possible both in the coupled state illustrated and in a decoupled state, after separation of the first dispenser module 1 and the second dispenser module 2.

For refilling the first dispenser module 1, the first dispenser module 1 has a refilling opening 15. In the exemplary embodiment illustrated, the refilling opening 15 is provided at an end of the medium chamber 10 that is opposite the discharge head 11. The refilling opening 15 is assigned a valve with a valve body 16, wherein the valve body 16 is forced by means of a restoring spring 17 onto a valve seat provided on the refilling opening 15. A housing of the medium chamber 10 is suitably designable by a person skilled in the art in order to provide and/or accommodate an abutment for the restoring spring 17.

In order to equalize the pressure during the filling and emptying, in a refinement the medium chamber 10 has a ventilation and venting device (not illustrated). In a refinement, the ventilation and venting device comprises a ventilation and venting path which is closed in an unactuated state of the pump unit 12 and is opened up when the pump unit 12 is actuated. By means of the ventilation and venting device, in a refinement the pump unit 12 of the first dispenser module 1 is adjusted via an adjustment path during filling such that the ventilation and venting path is opened up. The adjustment path here is preferably short, in particular shorter than an actuating path provided for actuating the pump unit 12. For supply of media to the pump unit 12, a rising tube (not illustrated) is preferably provided within the medium chamber 10. In alternative refinements, the medium is stored within the medium chamber 10 in a variable-volume flexible bag.

The second dispenser module 2 comprises a storage container 20 for storing the medium and a second discharge head 21, which is attached to the storage container 20 of the second dispenser module 2, with a pump unit 22 and a spray head 23. In a decoupled state (not illustrated) of the dispenser modules 1, 2, the spray head 23 is shiftable relative to the storage container 20, as a result of which the pump unit 22 is actuated in order to discharge the medium out of the storage container 20 and in order to dispense the medium at a first discharge opening 24. The spray head 23 illustrated furthermore has a second discharge opening 25. At least one valve body (not illustrated) is provided on the second discharge head 21, by means of which valve body, in the illustrated coupled state of the dispenser modules 1, 2, the first discharge opening 24 is closed and the first dispenser module 1 is fluidically coupled to the second discharge opening 25, and by means of which valve body, in a decoupled state of the dispenser modules 1, 2, the second discharge opening 25 is closed and the medium is dischargeable via the first discharge opening 24 when the second discharge head 21 is actuated. A ventilation system is provided for the purpose of equalizing the pressure during the discharging of the medium.

In order to refill the medium chamber 10, the air pump system 3 is actuated, wherein the air pump system 3 uses the ventilation system of the second discharge head 21. The air pump system 3 illustrated has a coupling sleeve 30 which is placeable onto the discharge head 21 of the second dispenser module 2. An actuation of the pump unit 22 of the discharge head 21 by shifting the spray head 23 is therefore not possible in the illustrated coupled state.

The air pump system 3 illustrated is a manually actuable air pump system 3 with a variable-volume pump chamber 31 and a reversibly deformable wall 32 designed as a bellows. In order to change the volume of the pump chamber 31, the bellows is compressed by application of a force (illustrated schematically by an arrow) in the axial direction 1 of the first dispenser module 1. In the exemplary embodiment illustrated, the bellows is guided here on a wall of the medium chamber 10. At an end of the pump chamber 31 facing the coupling sleeve 30, an opening 34 is provided, via which air escapes out of the pump chamber 31 in the direction of the second discharge head 21 in the event of compression of the bellows.

In the exemplary embodiment illustrated, the first dispenser module 1 and the air pump system 3 are designed as a common constructional unit which, as illustrated in FIG. 1, is coupleable to the second dispenser module 2 in order to refill the first dispenser module 1.

A plunger 35 is provided on the constructional unit comprising the first dispenser 1 and the air pump system 3. The plunger 35 is inserted into the discharge opening 25 and the refilling opening 15 when the dispenser modules 1, 2 are coupled, and therefore the valve assigned to the refilling opening 15 and the valve assigned to the discharge opening 25 are both opened. As a result, the medium chamber 10 is fluidically connected to the interior of the second discharge head 21 in the coupled state of the dispenser modules 1, 2. By means of suitable means, the first discharge opening 24 is closed in the coupled state.

As can be seen in detail in FIG. 2, the pump unit 22 illustrated comprises a pressure chamber 26 which is fluidically connected to the storage container 20 via an inlet valve with a valve body 27. The inlet valve opens when the pressure in the storage container 20 exceeds the pressure in the pressure chamber 26 by a threshold value. A slide 28 which is of two-part design in the exemplary embodiment illustrated is provided for changing the volume of the pressure chamber 26. When the pump unit 22 is actuated in the decoupled state, the slide 28 is adjusted because the spray head 23 shifts by application of an external force in the direction of the storage container 20 counter to the force of restoring springs, as a result of which the volume of the pressure chamber 26 is reduced. As a result, a medium present in the pressure chamber 26 is conveyed in the direction of the first discharge opening 24. When the force ceases, the slide 28 is moved into the initial position again because of the restoring forces of the restoring springs, and therefore a negative pressure arises in the pressure chamber 26, the inlet valve opens and the medium flows out of the storage container 20 into the pressure chamber 26.

In the coupled state illustrated in FIGS. 1 and 2, the slider 28 is displaced by means of the plunger 35 in the direction of a lower dead centre counter to the force of the restoring springs, wherein the spray head 23 remains in an initial position.

As can likewise be seen in FIG. 2, the discharge head 21 comprises a ventilation system with a ventilation opening 29 which opens in the storage container 20 and via which air can be supplied to the storage container 20 for the purpose of equalizing the pressure when the stored medium is discharged. In the exemplary embodiment illustrated, a ventilation and venting path comprising ventilation opening 29 is closed by means of a sealing element 4 in an unactuated state (not illustrated) of the pump unit 22. During a movement of the slide 28 in order to actuate the pump unit 22 in the decoupled state, or by means of the plunger 35 in the illustrated coupled state, the sealing element 4 opens up the ventilation and venting path.

The air pump system 3 is fluidically coupled to the ventilation system via the opening 34. By actuation of the air pump system 3, air is conveyed into the storage container 20 via the ventilation system. Owing to the positive pressure thus produced in the storage container 20, the medium flows out of the storage container 20 into the pressure chamber 26 and, via the opened valves of the second outlet opening 25 and of the refilling opening 15, into the medium chamber 10.

The invention claimed is:

1. Dispenser system, comprising a first dispenser module having:

a medium chamber which is fillable with a medium, a first discharge head which is actuable for discharging the medium out of the medium chamber, and a refilling opening, and a second dispenser module which is coupleable to the first dispenser module for refilling the latter, having:

a storage container for storing the medium, and a second discharge head which is attached to the storage container of the second dispenser module and which in a decoupled state of the dispenser modules is actuable for discharging the medium out of the storage container, said second discharge head having at least one discharge opening, wherein the second discharge head has a ventilation system for the purpose of equalizing the pressure in the storage container when the medium is discharged, and the dispenser system comprises an air pump system, wherein, in a coupled state of the dispenser modules, the air pump system is fluidically coupled to the ventilation system of the second discharge head and is actuable in order to convey air via the ventilation system into the storage container.

2. Dispenser system according to claim 1, wherein the air pump system and the first dispenser module are designed as a joint constructional unit.

3. Dispenser system according to claim 1, wherein the air pump system is designed as a manually actuable air pump system with a variable-volume pump chamber.

4. Dispenser system according to claim 3, wherein the manually actuable air pump system has a reversibly deformable wall.

5. Dispenser system according to claim 4, wherein the deformable wall is designed as a bellows which is variable in length in an axial direction of the first dispenser module.

6. Dispenser system according to claim 1, wherein the second discharge head has a pressure chamber, wherein the pressure chamber is fluidically connected to the storage container via an inlet valve.

7. Dispenser system according to claim 1, wherein at least one plunger is provided on the air pump system and/or on the first dispenser module and, in the coupled state, a valve assigned to the refilling opening and/or a valve assigned to the at least one discharge opening of the second discharge head are/is opened in a forcibly guided manner by the at least one plunger.

8. Dispenser system according to claim 1, wherein the at least one discharge opening comprises a first discharge opening and a second discharge opening, wherein, in the coupled state of the dispenser modules, the first discharge opening is closed and the first dispenser module is fluidically coupled to the second discharge opening, and, in the decoupled state of the dispenser modules, the second discharge opening is closed and the medium is dischargeable via the first discharge opening when the second discharge head is actuated.

9. Dispenser system according to claim 1, wherein the air pump system has a coupling sleeve which is placeable onto the second discharge head.

10. Dispenser system according to claim 1, wherein the second discharge head has a pump unit which is actuable in order to discharge the medium, wherein the ventilation system comprises a ventilation and venting path which is released when the pump unit is actuated, and wherein, in the coupled state of the dispenser modules, the pump unit of the second discharge head is at least partially transferred into an actuated state.

11. Method for refilling a dispenser module of a dispenser system comprising a first dispenser module having a medium chamber which is fillable with a medium, and a refilling opening, and a second dispenser module which is coupleable to the first dispenser module for refilling the latter, having a storage container for storing the medium and a second discharge head which is attached to the storage container of the second dispenser module and, in a decoupled state of the dispenser modules, is actuable for discharging the medium out of the storage container, wherein, in a coupled state of the dispenser modules, air is conveyed into the storage container via a ventilation system, which is provided on the second discharge head for the purpose of equalizing the pressure in the storage container when the medium is discharged, and therefore a positive pressure is produced in the storage container.

12. Dispenser system comprising:

a first dispenser module comprising a medium chamber which is fillable with a medium, a first discharge head which is actuable for discharging the medium out of the medium chamber, and a refilling opening;

a second dispenser module coupleable to the first dispenser module for refilling the first dispenser module;

the second dispenser module comprising a storage container for storing the medium and a second discharge head attached to the storage container of the second dispenser module, the second discharge head in a decoupled state of the dispenser modules is actuable for discharging the medium out of the storage container, and the second discharge head having at least one discharge opening;

the second discharge head having a ventilation system for equalizing the pressure in the storage container when the medium is discharged; and an air pump system surrounding the storage container and fluidically coupled to the ventilation system of the second discharge head in a coupled state of the dispenser modules, the air pump system is actuable in order to convey air via the ventilation system into the storage container.

13. Dispenser system according to claim 12, wherein the air pump system comprises a bellows surrounding the storage container and which is variable in length in an axial direction of the first dispenser module.

* * * * *